US006418157B1

(12) United States Patent
Fox

(10) Patent No.: US 6,418,157 B1
(45) Date of Patent: Jul. 9, 2002

(54) ROOF FOR A METALLURGICAL LADLE/ FURNACE

(75) Inventor: Peter Fox, Sheffield (GB)

(73) Assignee: RHS Paneltech Limited, Sheffield (GB)

( * ) Notice: Subject to any disclaimer, the term of this patent is extended or adjusted under 35 U.S.C. 154(b) by 0 days.

(21) Appl. No.: 09/666,394

(22) Filed: Sep. 20, 2000

(30) Foreign Application Priority Data

Sep. 24, 1999 (GB) ..... 9922542

(51) Int. Cl.[7] ..... F27D 1/02

(52) U.S. Cl. ..... 373/74; 373/8; 373/9; 373/73

(58) Field of Search ..... 373/71–76, 8, 373/9

(56) References Cited

U.S. PATENT DOCUMENTS

| | | | | |
|---|---|---|---|---|
| 4,903,640 | A | 2/1990 | Howard | 122/6 A |
| 4,995,051 | A | 2/1991 | Hakulin et al. | 373/81 |
| 5,241,559 | A | 8/1993 | Hixenbaugh | 373/74 |

FOREIGN PATENT DOCUMENTS

| | | |
|---|---|---|
| DE | 19729317 | 1/1999 |
| DE | 19855689 | 9/1999 |
| EP | 0581203 | 2/1994 |
| EP | 0805325 | 11/1997 |
| EP | 0805327 | 11/1997 |
| EP | 0892236 | 1/1999 |
| GB | 2176883 | 1/1987 |
| GB | 2220255 | 1/1990 |
| WO | WO9941560 | 8/1999 |

OTHER PUBLICATIONS

A Search Report which issued in connection with a corresponding British patent application.

A Search Report dated Jun. 14, 2001 which issued in connection with a corresponding French application.

*Primary Examiner*—Tu Ba Hoang
(74) *Attorney, Agent, or Firm*—Trexler, Bushnell, Giangiorgi, Blackstone & Marr, Ltd.

(57) ABSTRACT

A roof (3) for a metallurgical ladle/furnace (L.A.F) (1) comprising a self-supporting structure of metallic pipework (4) defining at least one flow circuit for cooling water, with a lower end having a circular peripheral flange (A), with a cylindrical body member (c) of smaller diameter than the flange (A) located above the flange (A) (in use away from the ladle/furnace), and is provided with an end wall (14) having a plurality of apertures (14) each to receive, in a gas-tight manner, a carbon electrode (8), and an aperture (5) for fume extraction provided in the arcuate wall (16) of the cylindrical body member.

8 Claims, 3 Drawing Sheets

ROOF FOR A METALLURGICAL LADLE/ FURNACE

FIELD OF THE INVENTION

This invention relates to a roof for a metallurgical ladle/ furnace with a facility for fume extraction.

BACKGROUND OF THE INVENTION

Such a roof for a ladle arc furnace (L.A.F.) comprises a self-supporting structure of metallic pipework defining at least one cooling water circuit, with three apertures in its central region each to accommodate a carbon electrode.

It is essential to collect, and dispose of, fume emitted from the melt during processing and one proposal is to collect some two thirds of the fume volume from a peripheral collection collar, with some one third collected by draw-off through an annular gap around each electrode. In practice, and particularly because of the use of circular section metallic pipework, peripheral collection soon becomes ineffective due to slag splash, which results in a build-up of slag that throttles or blocks inlet apertures to the collar, resulting in extensive volumes of fumes exiting via the annular gaps. Apart from the gaps having, a finite flow capacity, serious wear is effected by the fume/gas flow and acceleration of particulates on the relatively expensive electrodes. In addition, such roofs must be frequently removed, ideally before the combined weight of the roof and slag exceeds the lifting capacity of the associated lifting equipment, for manual removal of the slag build-up with air hammers and similar chisel tools, during the course of which the pipework is frequently damaged, if only by deformation rather than puncture, resulting in a reduced tube cross-section and throttled water flow, whereas L.A.F. roofs must have a predetermined water flow rate if they are not to be the subject of cracking and premature failure due to overheating.

OBJECT OF THE INVENTION

A basic object of the invention is the provision of an improved L.A.F roof.

SUMMARY OF THE INVENTION

According to the present invention there is provided a roof for a metallurgical ladle/furnace (L.A.F) comprising a self-supporting structure of metallic pipework defining at least one flow circuit for cooling water, with a lower end having a circular peripheral flange characterised in that:

(i) a cylindrical body member of smaller diameter than the flange is located above the flange (in use away from the ladle/firnace), and is provided with an end wall having a plurality of apertures each to receive, in a gas-tight manner, a carbon electrode, and (ii) an aperture for fume extraction is provided in the arcuate wall of the cylindrical body member.

ADVANTAGES OF THE INVENTION

Compared with prior art proposals, no fume extraction at all occurs via annular gaps surrounding the electrodes where the electrodes enter the roof, and hence no abrasion and resulting loss of carbon from the electrodes occurs as a result of fume extraction. In addition, as the arcuate wall of the cylindrical body member would normally extend vertically, and as its aperture(s) is more distant from the melt than prior art proposals, the propensity for splashed slag to rise as far as the aperture of the cylindrical body member and there adherence resulting in slag build up and aperture restriction or eventual blockage is remote if not impossible.

PREFERRED FEATURES OF THE INVENTION

The roof is assembled wholly or principally from rolled, rectangular hollow sections, with adjacent sections secured together by welding. The use of such sections, precludes the adherence of slag, in contrast to prior art roofs of circular section tubing that present "shelves" that encourage the adherence and accumulation of slag.

The hollow sections are bent to the required curvature and water flow passages cut into adjacent section for zig-zag water flow, in the known manner.

The roof has one water circuit, two water circuits extending over 180° segments, three water circuits extending over 120° segments, or four water circuits extending over 90° segments, depending on a number of design factors.

The cylindrical body member has plural fume exit apertures such as two 180° apart, three 120° apart or four 90° apart. The or each fume apertures is/are connected to ducting to convey the fumes to downstream treatment equipment, such as scrubbers or precipitators.

Interposed between the cylindrical body member and the circular peripheral flange is an intermediate zone.

The intermediate zone is of larger diameter than the cylindrical body member, and of smaller diameter than the flange.

In one embodiment, a transition zone between the lower portion of the cylindrical body member and the upper portion of central zone is completely open.

In another embodiment, the transition zone between the cylindrical body member and the central zone is partly closed off by a fixed or removable wall that, being in use closer to the melt than aperture of the cylindrical body member, serves as a slag splash shield.

The peripheral flange is also apertured for fume take-off peripherally in addition to fume take-off via the cylindrical body member.

The peripheral flange aperture is constructed from rolled hollow section tubing so as to present only vertical or horizontal faces, and no planar or arcuate "shelf" that would invite slag build up.

BRIEF DESCRIPTION OF THE DRAWINGS

The accompanying drawings are provided by way of example, in which.

DETAILED DESCRIPTION OF THE DRAWINGS

Figure 1:
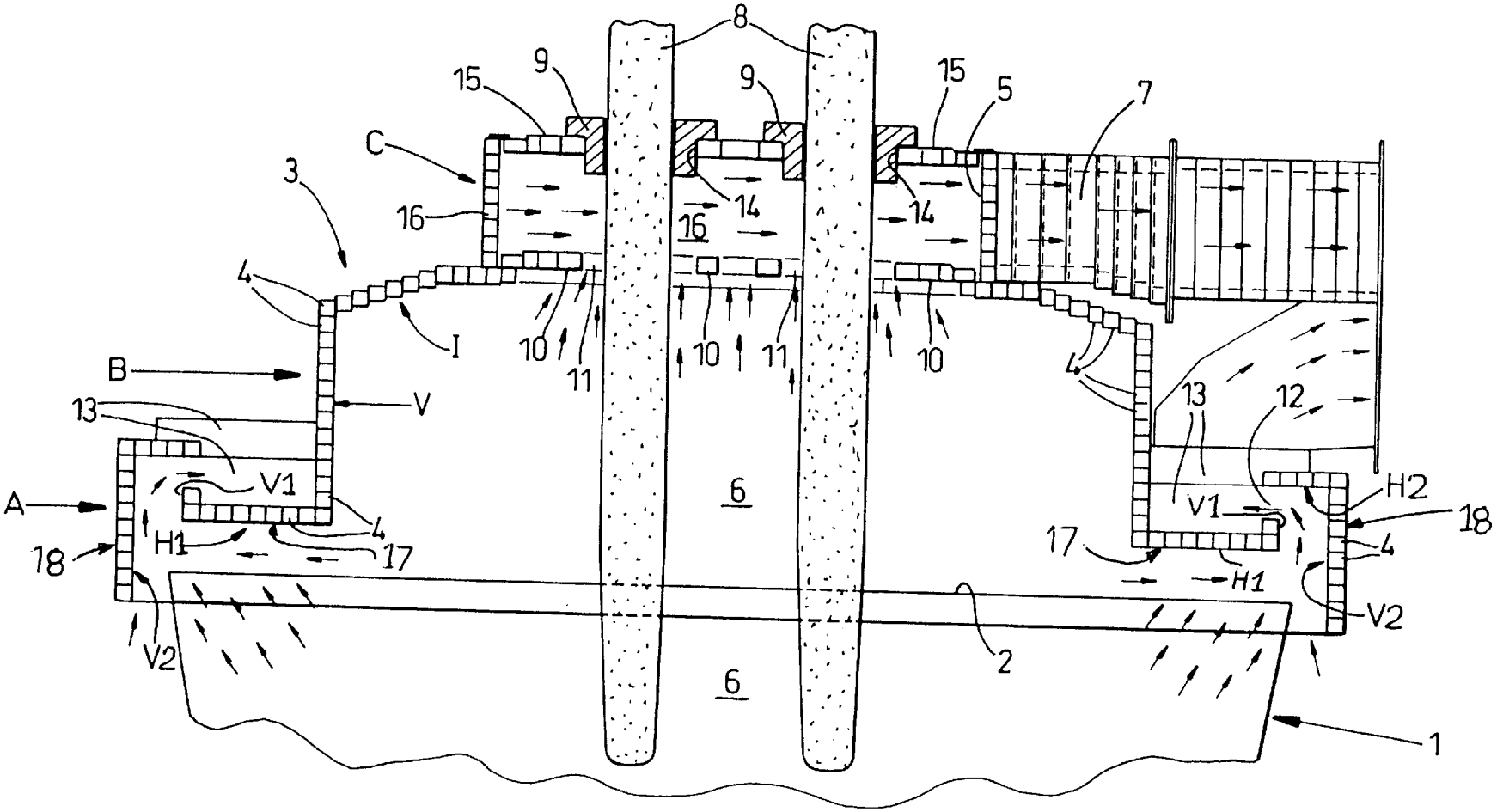
FIG. 1 is a diagrammatic, axial sectional view through a first embodiment of L.A.F roof. in accordance with the invention.

In all embodiments, like components are accorded like ref numerals.

In the drawings, a ladle arc furnace (L.A.F) 1 has an upper rim 2, and a roof 3 in accordance with the invention is adapted to be lowered, by crane (not shown), into close proximity with the rim 2.

The roof 3 for use in conjunction with the furnace 1 is fabricated from self-supporting, rectangular hollow section steel pipework 4 butted and/or stacked together at adjacent faces and welded one to the other, in a known manner, to build up a roof of required configuration.

Basically, the roof 3 in accordance with the invention comprises a circular peripheral flange defining component A, from which extends upwardly a cylindrical, intermediate structure defining component B, from which extends upwardly a cylindrical body member defining component C, the cylindrical body member having an aperture 5 in its arcuate wall 16 for fume take off from the interior 6 of the L.A.F. 1/roof 3 to a water cooled take-off conduit 7, again fabricated from rolled rectangular hollow section tubing to convey the fume to downstream scrubbers etc.

Components A, B, and C are all constructed from rectangular hollow section steel, which presents either horizontal faces H, or vertical faces V or inclined faces I, all of which dissuade slag adherence.

Three electrodes 8 (two only shown) pass through apertures 14 in an end wall 15 of the cylindrical body member C in a gas tight manner, by the employment of a refractory insert(s) or collars 9.

Figure 2:
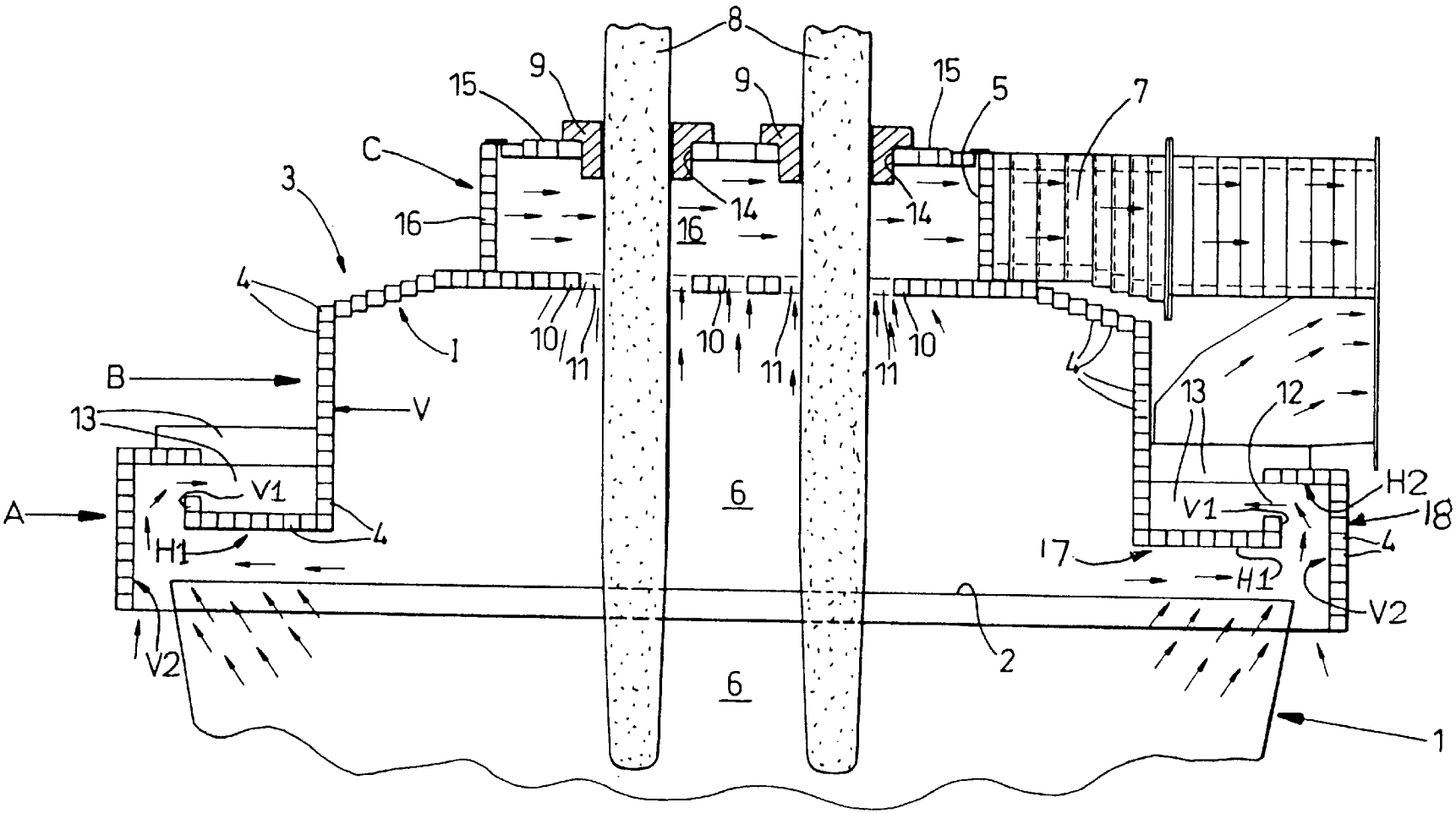
FIGS. 2 and 3, correspond to FIG. 1 but show second and third embodiments.

In the embodiment of FIG. 1 a removable wall 10 is provided between components B and C, whilst in the embodiment of FIG. 2, the wall 10 is fixed. In both embodiments the wall 10 presents over size annular holes 11 through which the electrodes 8 pass, so as to present no impediment to fume flow towards the aperture 5. The walls 10 serve as a slag splash barrier, protecting the aperture 5 from slag splash, slag build up, and aperture reduction, and resultant obstruction to flow of fume from the L.A.F. 1.

Figure 3:
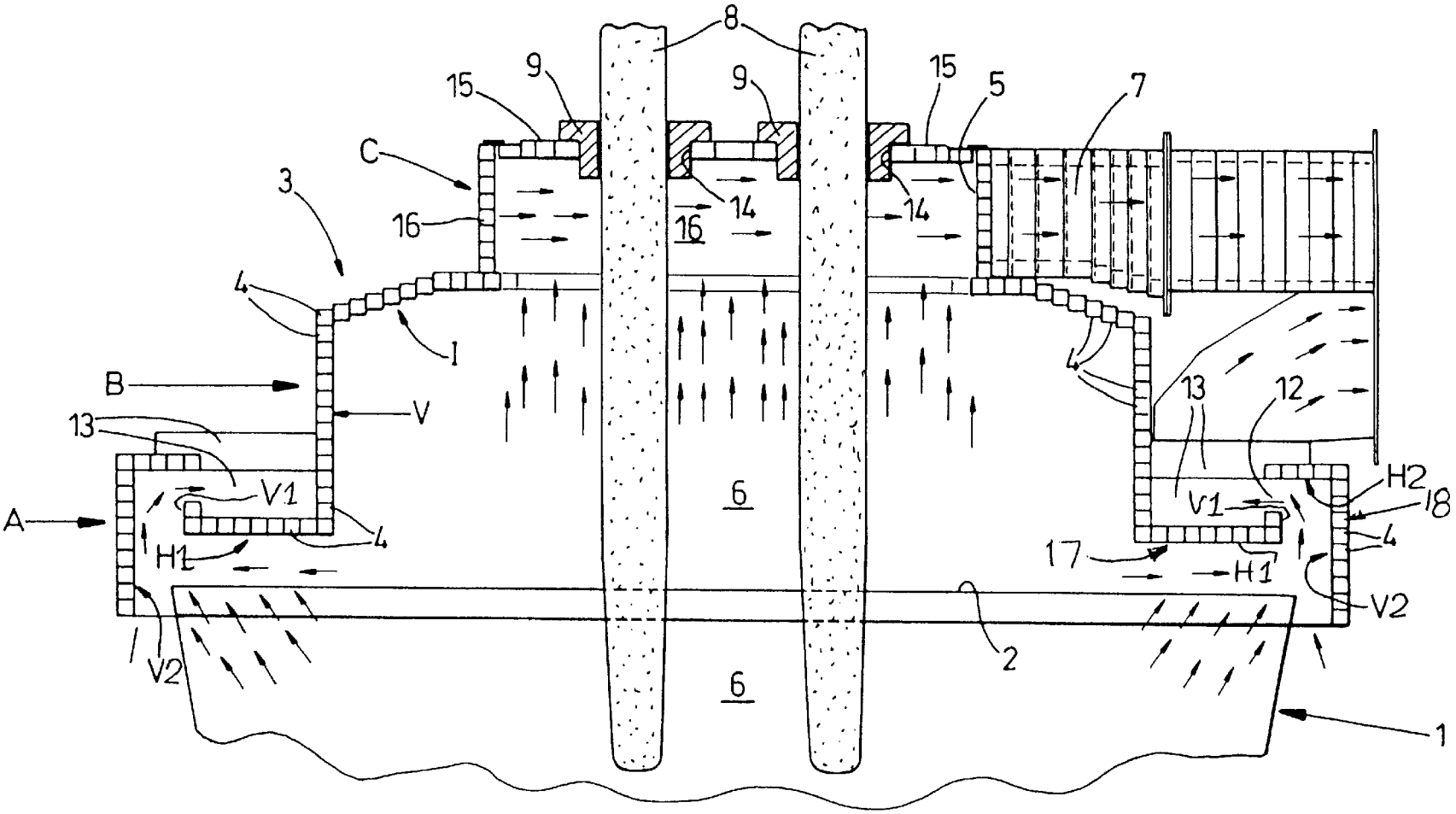

In the embodiment of FIG. 3, no wall 10 is present, the transition zone between components A and B being completely open.

In all embodiments, additional fume extraction is shown at component A viz the circular peripheral flange, which is provided with a series of arcuate apertures 12 connected to a water cooled peripheral fume take off 13.

It will be observed that even though the apertures 12 are in much closer proximity to the melt within the L.A.F. 2 than the aperture 5, and hence prone to slag splash, the use of rectangular hollow section tubing presents a vertical wall V or a horizontal wall H having, unlike prior art proposals no "shelf" on which slag splash build-up would occur.

What I claim is:

1. A roof for a metallurgical ladle arc furnace comprising a self-supporting structure fabricated from rectangular hollow section metallic pipework (4) and defining at least one flow circuit for cooling water, an upper, end wall of said roof having a plurality of apertures, each to receive, in a gas tight manner, a carbon electrode, said roof comprising:

(i) a component (A) defined by a circular peripheral flange, (ii ) a generally tubular component (B) of smaller diameter than said circular peripheral flange, and (iii) a peripheral fume take off route defined by portions of components (A) and (B), being:

(a) an annular flange (17) presenting both a lower, horizontal face (H1), and a vertical face (VI), a series of arcuate, fume exit apertures (12), and (b) an arcuate wall (18) presenting a vertical face (V2), and a horizontal wall (19) presenting a horizontal face (H2).

2. A roof as claimed in claim 1, wherein said hollow section metallic pipework is secured together by welding.

3. A roof as claimed in claim 2, wherein lengths of said hollow section metallic pipework are bent to the required curvature and water flow passages are cut into adjacent sections to provide for zig-zag, water flow.

4. A roof as claimed in claim 1, wherein said fume exit apertures are connectable to ducting to convey the fumes to downstream treatment equipment.

5. A roof as claimed in claim 1, wherein a cylindrical body member constitutes component (C) of smaller diameter than that of said component (B) and is located above component (B), and provided with an end wall, having an aperture for fume extraction in an arcuate wall portion.

6. A roof as claimed in claim 5, wherein a transition zone located between a lower end of said cylindrical body member and an upper end of said tubular component (B) is completely open.

7. A roof as claimed in claim 5, wherein a transition zone located between a lower end of said cylindrical body member and an upper end of said tubular component (B) is partly closed off by a fixed wall.

8. A roof as claimed in claim 5, wherein a transition zone located between a lower end of said cylindrical body member and an upper end of said tubular component (B) is partly closed off by a removable wall.

* * * * *